United States Patent [19]

Schupphaus et al.

[11] Patent Number: 4,828,326

[45] Date of Patent: May 9, 1989

[54] SHEARER LOADER FOR UNDERGROUND MINING OPERATION

[75] Inventors: Herbert Schupphaus; Siegfried Reike, both of Bochum, Fed. Rep. of Germany

[73] Assignee: Gebr. Eickhoff Maschinenfabrik u. Eisengiesserei mbH, Bochum, Fed. Rep. of Germany

[21] Appl. No.: 77,235

[22] Filed: Jul. 24, 1987

[30] Foreign Application Priority Data

Aug. 16, 1986 [DE] Fed. Rep. of Germany ..... 3627909

[51] Int. Cl.[4] ..... E21C 29/22

[52] U.S. Cl. ..... 299/42; 74/661; 74/665 L; 192/0.098

[58] Field of Search ..... 299/1, 43, 29, 42; 74/661, 665 L, 665 M, 665 N; 192/0.098

[56] References Cited

U.S. PATENT DOCUMENTS 3,633,081 1/1972 Weber ..... 299/1 X
4,315,439 2/1982 Grachtrup ..... 74/665 L X
4,453,774 6/1984 Knorr ..... 299/42
4,465,319 8/1984 Brownlie ..... 299/42
4,579,019 4/1986 Gabriele ..... 74/665 L X
4,646,896 3/1987 Hammond et al. ..... 192/0.098

FOREIGN PATENT DOCUMENTS 2126624 3/1984 United Kingdom ..... 299/1

*Primary Examiner*—Jerome W. Massie
*Assistant Examiner*—David J. Bagnell
*Attorney, Agent, or Firm*—Clifford A. Poff

[57] ABSTRACT

A shearer loader for underground mining operations including a duplex-input transmission coupled to the haulage box drive motor of the shearer loader. A first input of the duplex-input transmission is coupled to the haulage box office motor, and a second input of the duplex-input transmission is coupled to a drum-cutter drive motor of the shearer loader. During those times in which increased feed rates are required of the shearer loader, feed forces required for the increased feed rate is supplied by both the haulage box drive motor, and the drum-cutter drive motor.

6 Claims, 3 Drawing Sheets

SHEARER LOADER FOR UNDERGROUND MINING OPERATION

BACKGROUND OF THE INVENTION

1. Field of the Invention

This invention relates to a shearer loader for use in underground mining operations in which the shearer loader includes shearing drums connected through drive transmissions to a driving motor and a haulage box having a haulage box drive wheel connected by a reducing transmission to a driving motor for propelling the shearer loader along a mine face by engagement of a driving wheel of the haulage box with a rack or chain. The driving motor for the haulage box drive wheel is separate and independent from the driving motor for the shearing drums.

2. Description of the Prior Art

As disclosed in West German patent publication No. 1,171,376, it is known in the art to use a differential transmission in a mining tunneling machine to provide automatic control for the rate of advancement and a rate of cutting. The differential transmission is disposed in the shearing or cutting head of the mining machine. The machine drive motor supplies drive torque to the shearing drum by the differential transmission. The transmission takes the form of planetary gear transmission having a sun wheel connected by drive gears to the machine drive motor. The planetary gear transmission is also connected by drive gears to a hydraulic motor which drives the annulus of the planetary gear transmission and thereby supplies additional rotation to the transmission. The speed of the hydraulic motor can be varied in a stepless fashion and the direction of rotation can be reversed. In this motor and transmission arrangement, the speed of rotation provided by the machine drive motor can be adjusted in a stepless fashion by controlling the direction of rotation or by the output speed of the hydraulic motor whereby the output speed of the differential transmission is increased or reduced in a stepless fashion so that the shearing drum can be driven at a desired optimum speed.

Haulage boxes for shearer loaders used in underground mining are designed with a performance capability to operate at a maximum pull at a required rate of advancement of the mining machine. When the rate of advancement by the shearer loader overshoots a predetermined value, the maximum pull of the haulage box decreases because the product of the rate of advancement and pull is constant which determines the instantaneous output of the haulage box under any working condition.

Situations arise in underground mining operations that make it possible and even necessary for a shearer loader to be operated at a considerably greater rate of advancement if the haulage box could provide maximum pull at the increased rate of advancement. This is particularly true when fairly soft and free working coal seams are cut or when the operator of the shearer loader requires an extremely high mining performance beyond the driving power which the haulage box can provide.

SUMMARY OF THE INVENTION

It is an object of the present invention to provide a drive arrangement for supplying the haulage box of a shearer loader with additional driving power as required so that the haulage box can still provide a maximum pull at increased rates of advancement which is greater than the ordinary maximum rate of advancement.

More particularly, there is provided according to the present invention a shearer loader for underground mining in which a shearer loader includes a combination of a shearing drum for releasing material from a mine face, a shearing drum drive motor for rotatively driving the shearer drum, a haulage box including a haulage box drive output wheel, a haulage box drive motor for driving the haulage box drive output wheel, means engaged with the haulage box drive wheel for moving the shearer drum along the mine face, a duplex input transmission serially interconnecting a first drive input through drive gears to the haulage box drive motor and the haulage box drive output wheel, and drive gears for drivenly interconnecting a second drive input of the duplex input transmission to the shearing drum drive motor.

By the drive arrangement of the present invention, the haulage box is supplied with a drive torque in a first mode of operation only from the haulage box drive motor. In this mode the limit of motor performance covers even at maximum pull, a relatively wide speed range up to the limit of the motor performance. Beyond this limit, when the pull force decreases at higher rates of advancement by the shearer loader, the shearer drum drive motor or one of the shearer drum drive motors when more than one is powered, is used to contribute power to the haulage box which is needed to maintain a maximum pull beyond its normal speed range. The drive motor for the haulage box can comprise an electric motor or alternatively as is conventional a hydraulic motor can be used to drive the haulage box and a hydraulic or electric motor can be connected by way of gear transmission to the duplex input transmission.

A very compact drive arrangement is formed when the duplex input transmission includes a planetary gear transmission having a sun gear wheel connected by gearing to the shear drum drive motor. The planetary gear transmission further includes an annulus and a satellite carrier with the annulus connected by a drive gearing to the haulage box drive motor and the satellite carrier is connected by drive gears to an annulus of a speed reducing planetary gear transmission to rotate the haulage box drive output wheel. The advantage of this construction is that the drive gears of transmission elements of the same kind and dimensions can be used to a large extent both for the reduction transmission and for the duplex input transmission. Such an arrangement simplifies and reduces production costs as well as the requirements for spare parts while at the same time reducing the over-all size of the various gear transmissions.

The shearer loader of the present invention may further include a reversing transmission drivenly coupled between the shearer drum drive motor and the duplex input transmission. An overload clutch is used for limiting the portion of the driving force supplied from the shearer drum drive motor to the duplex input transmission for driving the haulage box drive out-put wheel. The reversing transmission and the overload clutch ensure that the haulage box can operate in both directions of rotation without overload by the extra drive torque supplied by the shearing drum drive motor. The drive torque of the shearing drum drive motor is substantially greater than the drive torque of the haulage box drive motor.

The shearer loader of the present invention may further include a brake operatively connected to the second drive input of the duplex input transmission. The provision of the brake permits the stoppage of the supply of drive torque from the shearer drum drive motor to the haulage box when required. The situation when such a stoppage is necessary occurs particularly when the shearing drum drive motor is to be supplied with full power to drive the shearer drum.

A brake and two clutches associated with the reversing transmission can be controlled by an electric control in response to an armature current of the shearing drum drive motor for interrupting the driving connection between the reversing transmission and the duplex input transmission and for operating the brake when an armature current set value is reached or overshot. Such an automatic control ensures that when the armature current set value is reached or overshot, the shearer drum drive motor ceases to supply torque to the haulage box. Also, if the shearer drum drive motor is not fully loaded, the unused torque is always made available for supply to the haulage box.

These features and the advantages of the present invention as well as others will be more fully understood when the following description is read in light of the accompanying drawings of which:

DETAILED DESCRIPTION OF THE INVENTION

Figure 1:
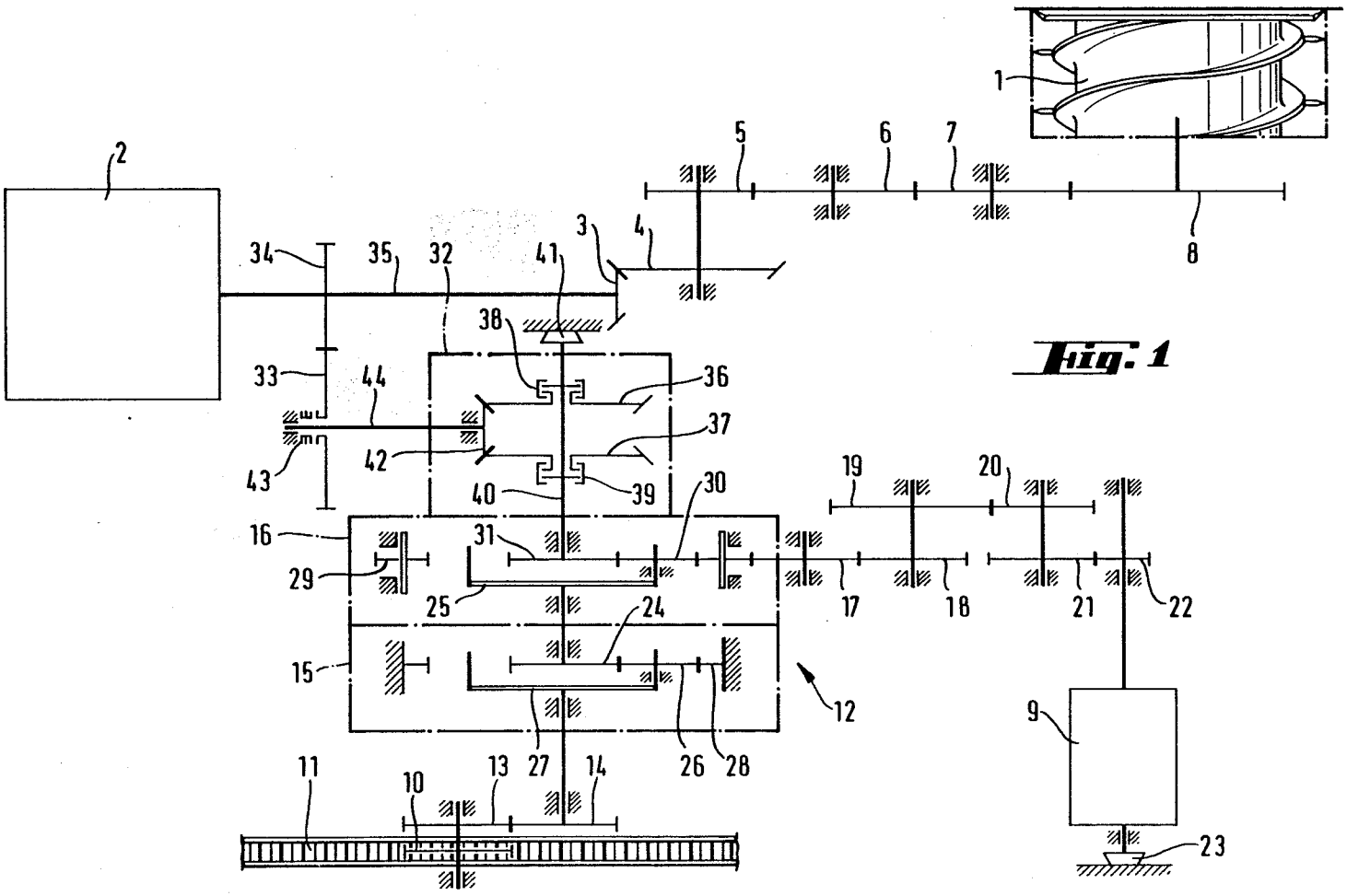
FIG. 1 is a schematic diagram of the shearer loader drive system according to one embodiment of the present invention.

Turning now to FIG. 1, there is illustrated a shearer drum of a shearer loader of a type per se known in the art. The shearer drum is driven by a drive motor 2 through transmission gear means in the form of bevel gears 3 and 4 and a train of drive pinions 5, 6, 7 and 8. Pinion 8 is connected to the drive input shaft of shear drum 1. Beveled gear 3 is connected to the drive output shaft of motor 2. Advancing movement of the shearer loader is produced by means of a drive motor 9 which operates through a haulage box drive 12, to be explained in greater detail hereinafter, to rotate a drive wheel 10 which is engaged with a rack 11 extending along the length of the mine face in a manner per se known in the art. The wheel 10 and motor 9 are connected by way of a pair of gears 13 and 14 of which gear 14 is mounted to an output shaft of a speed reducer transmission 15. Transmission 15 includes an input shaft that is serially connected to the output of a duplex input transmission 16. One input to transmission 16 is a gear 17 driven through pairs of gears 18, 19 and 20, 21. The gears 18-21 operate as counter shafting for a pinion gear 22 of the haulage box motor 9. An electromagnetic safety brake 23 is operated to secure the shearer loader against movement during down times when the motor 9 is turned OFF.

The transmissions 15 and 16 are embodied in the form of a planetary gear transmission. The speed reducing transmission 15 includes a sun wheel 24 connected to a satellite carrier 25 of the duplex input transmission 16. The rotation of sun wheel 24 causes rotation of satellite gears 26 and satellite gear carrier 27. The satellite gear carrier 27 has a drive output shaft which as described previously is connected by way of gears 13 and 14 to driving wheel 10. In the operation of the reducing transmission 15 the satellite gears 26 roll on the internally toothed and non-rotatively mounted annulus 28.

The duplex input transmission 16, includes an annulus 29 rotatably mounted in the casing of a haulage box. On this annulus there are internally toothed ring and externally toothed ring. The externally toothed ring meshes with gear 17 and thus transmits and receives torque rotation originated with a haulage box motor 9. The annulus 29 in turn transmits rotation by way of the internally toothed ring thereof to satellite gears 30. The satellite gears 30 roll about a rotatable central sun gear wheel 31. In this way the satellite gears 30 drive a satellite carrier 25 which in turn transmits rotation to the speed reducer transmission 15 and hence to the drive wheel 10. The shaft of sun wheel 31 of the duplex input transmission 16 is connected by a reversing transmission 32 which is in turn connected by a pair of gears 33 and 34 to the drive output shaft 35 of the shearer drum drive motor 2. The reversing transmission 32 includes two coaxially arranged beveled gears 36 and 37 each of which can be drivenly connected by way of clutches 38 and 39 respectively to shaft 40. Shaft 40 carriers parts of clutches and is connected to sun wheel 31. A brake 41 operates on shaft 40 to secure this shaft against rotation and therefore also sun wheel gear 31. The bevel gears 36 and 37 mesh with a common bevel gear 42 having teeth which engage at opposite sides thereof with the gears 36 and 37. Bevel gear 42 is drivingly connected to a shaft 44 which is also connected by way of an overload clutch 43 to bevel gear 33 so that torque which driving motor 2 can input to the reversing transmission 32 is limited in magnitude by the overload clutch 43.

Figure 2:
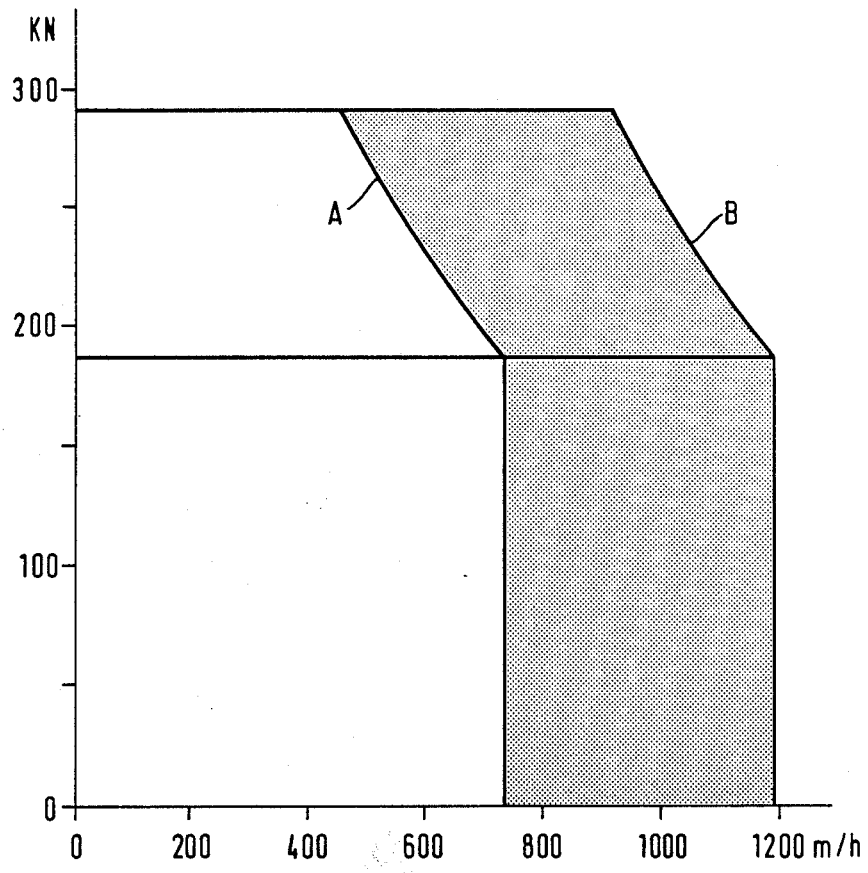
FIG. 2 is a graph showing the power supply to the haulage box of the shearer loader versus the speed or rate of advancement by the shearer loader along a mine face.

When one of the beveled gears 36 and 37 is coupled to shaft 40 by operation of the respective clutches 38 and 39, some of the torque from motor 2 is supplied as a supplemental force to sun wheel 31 of transmission 16 in the required direction of rotation as determined by the direction of travel of the shearer loader along the mine face. Consequently, torque inputs occur from driving motor 2 and from the haulage box motor 9 which are combined in the duplex input transmission 16 and supplied by way of satellite carrier 25 to the reduction transmission 15 for delivery to the driving wheel 10. In this way, the haulage box drive 12 can be driven at an increased speed without any reduction to the maximum pull as is apparent from the diagram of FIG. 2. In FIG. 2, the pull force developed by the haulage box is plotted against the rate of travel by the haulage box. The family of lines "A" represents the relationship between the haulage box pull and the rate of machine advance when the pull is provided solely by the haulage box motor 9. The family of curves "B" represents the relationship between the haulage box pull force and the rate of the machine advance when the shearer drum drive motor 2 assumes some of the load transmitted through the haulage box drive 12. The machine speed range in which the haulage box drive 12 operates at a maximum pull is approximately doubled.

Under normal operating conditions, when the haulage box motor is used solely to supply the required pull force to move the shearer loader along the mine face, brake 41 is operated to retain shaft 40 and gears 36 and 37 of the reversing transmission 32 in a disengaged state. It is only when the output torque of the haulage box motor 9 is inadequate at relatively high speeds to produce the required rate of advancement by the shearer drum drive motor that the clutches 38 and 39 is engaged depending on the direction of machine travel, brake 41 is released, so that driving motor 2 supplies a part of its torque output to the haulage box transmission to boost the torque supply thereto through operation of the haulage box motor 9. The operator of the shearer loader can release brake 41 and operate the clutches 48 and 49 to connect one of the gears 36 and 37 of the reversing transmission 32 to shaft 40. However, the operation of the brake 41 and clutches 38 and 39 can be preformed automatically as shown by illustration of FIG. 3 is a dependent relation upon the current load in the shearer drum drive motor 2.

Figure 3:
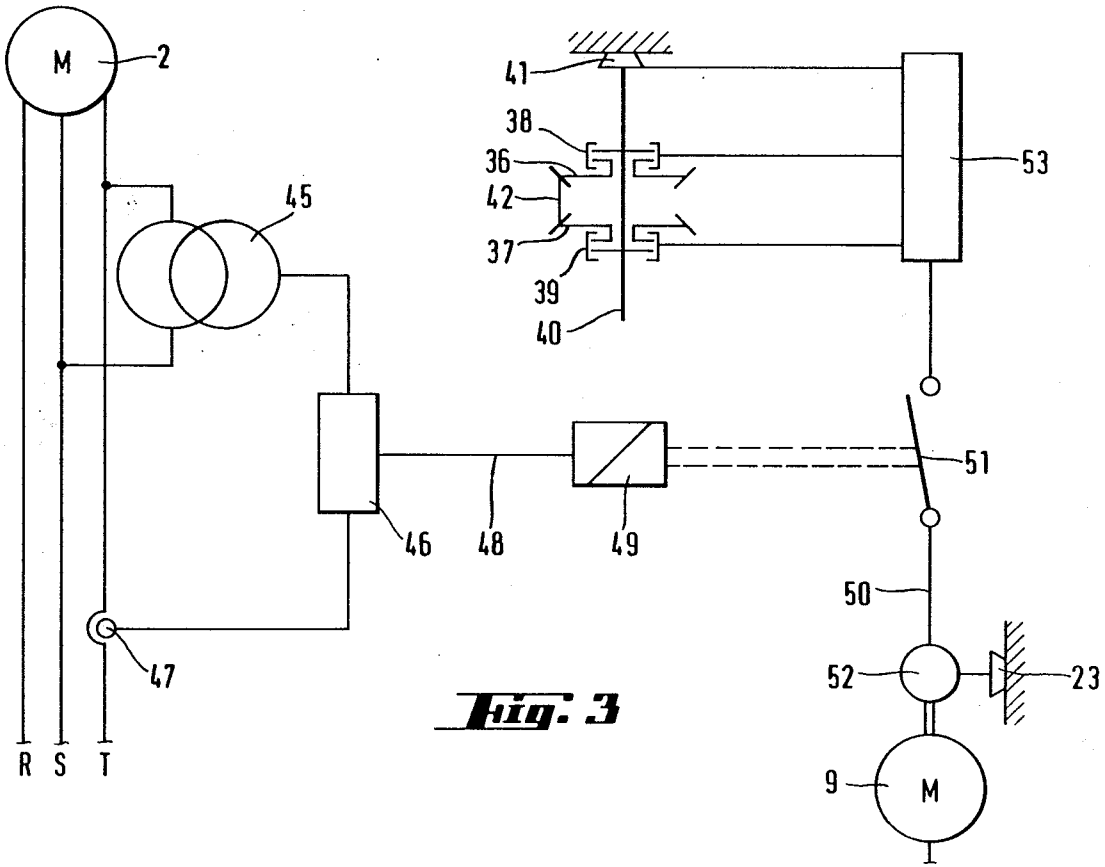
FIG. 3 is a circuit diagram for an automatic operation of part of the drive system shown in FIG. 1.

As illustrated schematically in FIG. 3, the shearer drum drive motor 2 is powered by way of conductors R, S and T. A voltage transformer 45 supplies a signal corresponding to a motor load set value to a comparator element 46 which also receives a signal from the output of a current transformer 47 corresponding to the actual value of the armature current, i.e. the actual value of the motor loading. It is only when the actual value of the motor loading is below a corresponding motor current set value that the comparator element acts by providing a signal in line 48 to relay 49 closing a switch 51 in line 50. The switch 51 connects a tachometer 52 driven by the haulage box motor 9. The switch 51 when closed connects line 50 to element 53. The tachometer 52 delivers an output signal which differs in polarity in a dependent relation upon the direction of rotation by the tachometer 52 which is controlled by the direction of the travel by the shearer loader along the mine face. Element 53 is a controller which transmits signals corresponding to the polarity of the input signal from the tachometer for operating the clutch 38 or clutch 39. This ensures that the motor 2 always acts to impart rotation to shaft 40 in a direction of rotation for supplementing the power which is output by the haulage box motor 9. When either of the clutches 38 and 39 is operated, element 53 outputs a signal to release the brake 41.

The control system shown in FIG. 3 operates to automatically ensure that a limited proportion of power delivered by the shearing drum drive motor is available for delivery to the haulage box 12 when the armature current of the shearer drum drive motor 2 is below a set value. However, when the loading of the shearing drum drive motor 2 reaches its set value, the power which is used to supplement the power developed by the haulage box motor 9 ceases as relay 49 operates to open switch 51 interrupting the signal delivered by line 52 to the control elements 53. In the absence of an input signal to the elements 53, there is no output signal. Consequently, the brake 41 which is spring biased operates and the clutches 38 or 39 are released which also interrupts the drive connection between the bevel gear 36 or 37 and the shaft 40.

Although the invention has been shown in connection with a certain specific embodiment, it will be readily apparent to those skilled in the art that various changes in form and arrangement of parts may be made to suit requirements without departing from the spirit and scope of the invention.

We claim:

1. A shearer loader for underground mining, said shearer loader including the combination of:
   - a shearing drum for releasing material from a mine face;
   - a shearing drum drive motor for rotatively driving said shearing drum;
   - a haulage box including a haulage box drive output wheel;
   - a haulage box drive motor for rotatively driving said haulage box drive output wheel;
   - means engaged with said haulage box drive wheel for moving the shearing drum along a mine face;
   - a duplex input transmission means serially connected by a first drive input and a drive transmission for drivenly connecting said haulage box drive motor and said haulage box drive output wheel; and
   - transmission means for drivenly connecting a second drive input of said duplex transmission means to said shearing drum drive motor.

2. The shearer loader according to claim 1 further including a shearer drum transmission for drivenly interconnecting said shearer drum and said shearer drum drive motor.

3. The shearer loader according to claim 1 wherein said duplex transmission means includes a planetary gear transmission having a sun gear wheel connected by gear means to said shearing drum drive motor, said planetary gear transmission further having an annulus and a satellite carrier with the annulus connected by gear means to said haulage box drive motor, and the satellite carrier drivenly connected by a transmission to an annulus of a speed reducing planetary gear transmission to drive the haulage box drive output wheel.

4. The shearer loader according to claim 3 further including a reversing transmission drivenly coupled between said shearing drum drive motor and said duplex input transmission means, an overload clutch for limiting the portion of driving force of said shearer drum drive motor which can be transmitted by the duplex input transmission means to said haulage box drive output wheel.

5. The shearer loader according to claim 4 further including a brake operatively connected to said second drive input of said duplex input transmission means.

6. The shearer loader according to claim 5 wherein said reversing transmission includes two clutches for controlling reversing of driving forces and wherein said shearer loader further includes electric control means responsive to an armature current of said shearing drum drive motor for interrupting the driving connection between said reversing transmission and said duplex input transmission means and for operation of said brake when an armature current set value is reached or overshot.

* * * * *